US005814936A

United States Patent [19]

Martinet

[11] Patent Number: 5,814,936

[45] Date of Patent: Sep. 29, 1998

[54] LOW-PRESSURE MERCURY DISCHARGE LAMP

[75] Inventor: Karel L. Martinet, Terneuzen, Netherlands

[73] Assignee: U.S. Philips Corporation, New York, N.Y.

[21] Appl. No.: 857,547

[22] Filed: May 16, 1997

[30] Foreign Application Priority Data

May 17, 1996 [EP] European Pat. Off. ..... 96201392

[51] Int. Cl.[6] ..... H01J 61/20; H01J 61/24; H01J 7/10

[52] U.S. Cl. ..... 313/545; 313/550; 313/490

[58] Field of Search ..... 313/545, 550, 313/565, 566, 564, 400

[56] References Cited

U.S. PATENT DOCUMENTS 4,288,715 9/1981 Van Overveld et al. ..... 313/565
4,622,495 11/1986 Smeelen ..... 313/550
4,794,301 12/1988 Misono et al. ..... 313/490
5,559,392 9/1996 Cocoma et al. ..... 313/490

OTHER PUBLICATIONS

Research Disclosures, Jun. 1995, p. 458.

*Primary Examiner*—Nimeshkumar Patel
*Attorney, Agent, or Firm*—F. Brice Faller

[57] ABSTRACT

A low-pressure mercury discharge lamp is provided with a light-transmitting discharge vessel (10) which contains mercury and a rare gas and which comprises means (20) for maintaining an electric discharge in the discharge vessel. A metal holder (30) supporting an amalgam (31) is arranged in the discharge vessel. The holder (30) is a metal plate (33) bent about an axis (32), portions **(34*a*, 34*b*) of the plate bent towards one another defining a slot (35), while the holder is pinched together at its ends (36) and the amalgam (31) coats the holder on an internal surface (37)** thereof. The manufacture of the holder is simple.

3 Claims, 4 Drawing Sheets

LOW-PRESSURE MERCURY DISCHARGE LAMP

BACKGROUND OF THE INVENTION

The invention relates to a low-pressure mercury discharge lamp provided with a light-transmitting discharge vessel which surrounds a discharge space containing mercury and a rare gas, and provided with means for maintaining an electric discharge in said discharge space, a metal holder supporting an amalgam being arranged inside the discharge space.

Such a low-pressure mercury discharge lamp is known from Research Disclosures, June 1995, p. 458. An embodiment of the known lamp is an electrodeless low-pressure mercury discharge lamp. A coil having a winding of an electrical conductor is arranged in a cavity of the discharge vessel. The coil generates a high-frequency magnetic field during operation, thus maintaining an electric discharge in the discharge vessel. The amalgam in the known lamp is enclosed in an iron, cup-shaped holder which is covered by a gauze of tungsten. After the lamp has been switched on, the discharge heats the amalgam, so that mercury contained in the amalgam is released. This accelerates the rise in mercury vapor pressure in the discharge space, so that the lumen output of the lamp will rise quickly to the value accompanying nominal operation. The holder prevents the amalgam from being exposed to the discharge. This is important, in particular in highly loaded lamps, to avoid sputtering away of the amalgam.

In an alternative embodiment of the known lamp, the means for maintaining the discharge are formed by a pair of electrodes in the discharge vessel. In this embodiment, the holder with the amalgam is heated by an electrode near which the holder is positioned after the lamp has been switched on.

In the known lamp, dosing and applying of the amalgam as well as placing and fastening of the gauze render the manufacture of the holder complicated.

SUMMARY OF THE INVENTION

It is an object of the invention to provide a low-pressure mercury discharge lamp of the kind described in the opening paragraph whose amalgam holder can be manufactured in a simpler manner.

According to the invention, the low-pressure mercury discharge lamp of the kind described in the opening paragraph is for this purpose characterized in that the holder is a metal plate bent about an axis, and in that portions of said plate bent towards one another define a slot, the holder being pinched together at its ends, while the amalgam covers an internal surface of the holder.

The holder formed by the metal plate protects the coating of amalgam on its internal surface, while mercury vapor transport can take place between the amalgam and the discharge space outside the holder via the slot.

The holder is made, for example, of iron, nickel, or an alloy such as CrNiFe, for example with 18% Cr, 12% Ni, remainder Fe by weight. Suitable metals for forming an amalgam with mercury are, for example, indium or an alloy of lead and tin. The amalgam may be applied to the internal surface of the holder via an intermediate layer, for example, an intermediate layer made of cobalt. An intermediate layer may be formed by an alloy of the amalgam-forming metal and the metal of the holder.

The holder of the low-pressure mercury discharge lamp according to the invention can be readily manufactured from a metal tape coated with amalgam on one side. Said tape is then bent parallel to its longitudinal direction about a longitudinal axis. Then portions may be separated off from the tape thus bent, for example through sawing of these portions of the tape. Preferably, however, the portions are separated from the tape through shearing. The portions obtained through shearing already have pinched ends, so that a separate operation for this purpose is unnecessary.

The quantity of amalgam supported by the separated portion may be readily dosed through a suitable choice of the length of this portion.

Since the amalgam coating is provided on the inside of the bent tape, no or substantially no amalgam remnants remain on the tool used for shearing after the operation.

The simplicity with which the amalgam holder can be manufactured renders it attractive to have this manufacture take place near the location where the assembly with the other lamp components takes place. The amalgam holder may then be fed to the assembling device immediately after its manufacture, while it still has a well defined position, which simplifies the assembling operation.

An embodiment of the low-pressure mercury discharge lamp according to the invention which is comparatively easy to manufacture is one which is characterized in that the slot extends between edge portions of the metal tape which face towards one another.

Alternatively, the edge portions may overlap, or the tape may be bent twice or more times about its longitudinal axis, so that the holder will have a spiralling cross-section.

BRIEF DESCRIPTION OF THE DRAWINGS

These and other aspects of the low-pressure mercury discharge lamp according to the invention will be explained in more detail with reference to the drawing, in which.

DETAILED DESCRIPTION OF THE PREFERRED EMBODIMENTS

Figure 1:
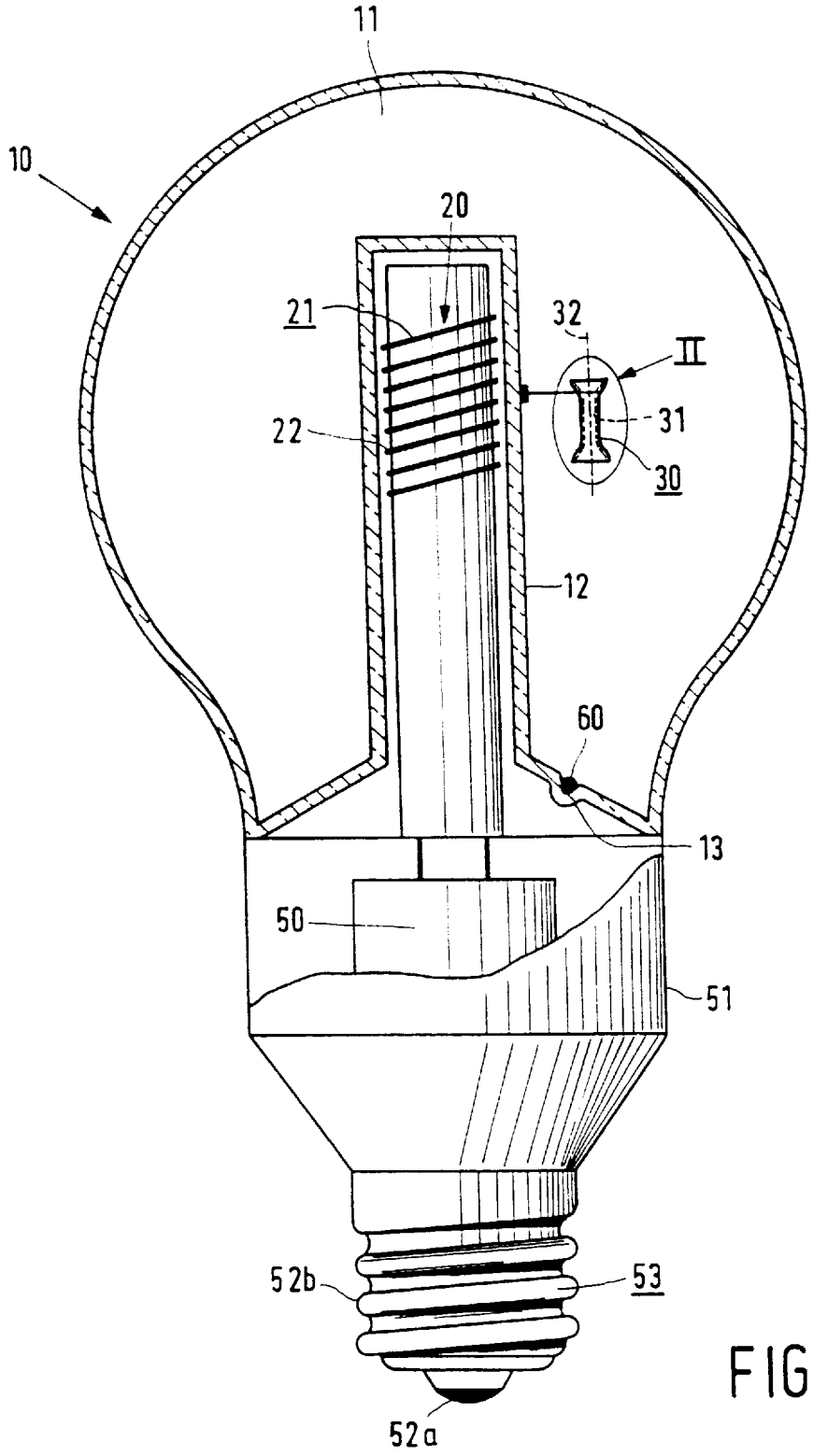
FIG. 1 shows a first embodiment of the low-pressure mercury discharge lamp according to the invention.
Figure 2:
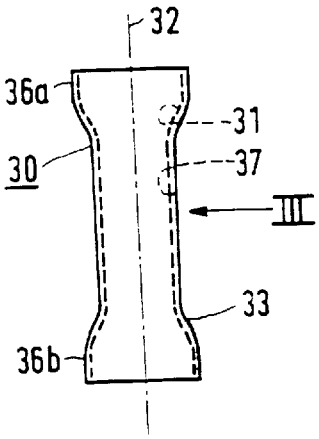
FIG. 2 shows the holder of the low-pressure mercury discharge lamp of FIG. 1.
Figure 3:
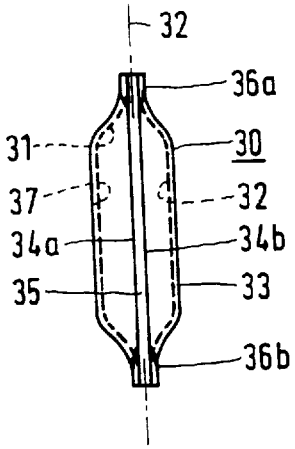
FIG. 3 is an elevation viewed along III in FIG. 2.

FIG. 1 shows a low-pressure mercury discharge lamp provided with a light-transmitting discharge vessel 10. The discharge vessel 10 surrounds a discharge space 11 which contains a filling of mercury and a rare gas. The lamp is in addition provided with a coil 21 having a winding 22 of an electrical conductor which is arranged in a cavity 12 of the discharge vessel 10. The coil 21 generates a high-frequency magnetic field during lamp operation. The coil 21 forms means 20 for maintaining an electric discharge in the discharge space 11. The coil 21 is connected to a lamp supply unit 50 which is arranged in a housing 51 fastened to the discharge vessel 10. The lamp supply unit 50 is connected to contacts 52*a*, 52*b* of a lamp cap 53 at the housing 51. A metal holder 30 supporting an amalgam 31 is arranged in the discharge space 11. After switching-on of the lamp, the electric discharge in the discharge space results in a temperature increase of the amalgam 31, which causes mercury contained therein to be quickly released. The holder 30 (shown in more detail in FIGS. 2 and 3) is a metal plate 33, here made of nickel, which was bent about an axis 32 such that portions 34*a*, 34*b* of the plate bent towards one another define a slot 35, while the holder is pinched together at its ends 36*a*, 36*b*. The amalgam 31 (shown in broken lines), made of indium and mercury here, covers the holder 30 on an internal surface 37 thereof. A further amalgam 60 is present in a recessed wall portion 13 of the discharge vessel 10. The recessed wall portion 13 forms a comparatively cold spot within the discharge vessel 10, so that the further amalgam 60 limits the mercury vapor pressure to a value desired for nominal operation.

Figure 4:
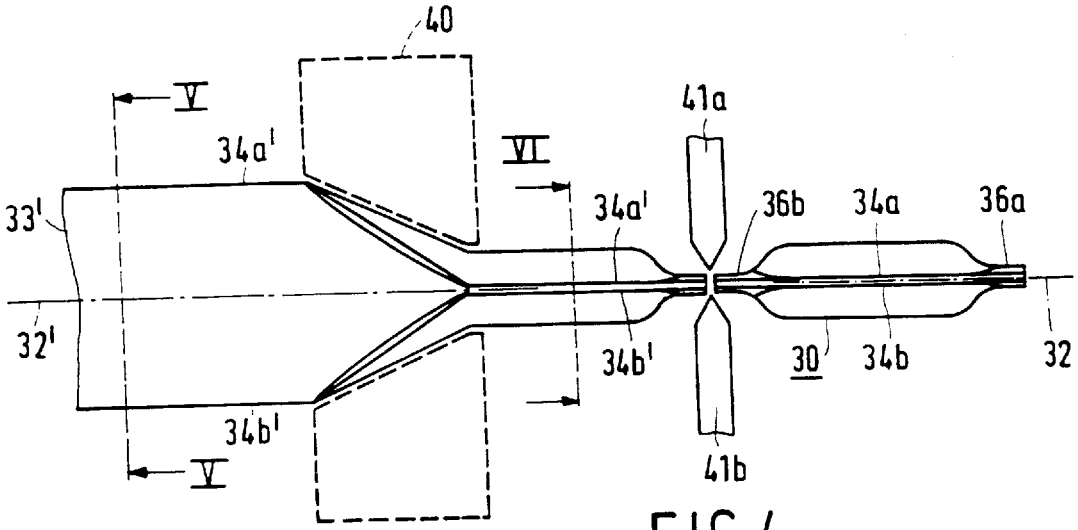
FIG. 4 depicts a method of manufacturing the amalgam holder.
Figure 5:
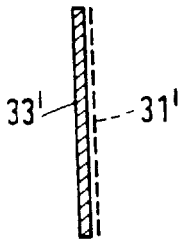
FIG. 5 is a cross-section taken on the line V—V in FIG. 4.
Figure 6:
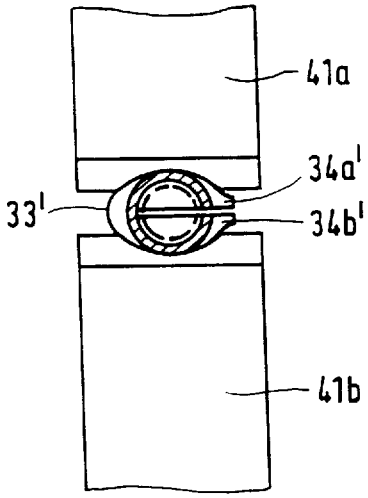
FIG. 6 is a cross-section taken on the line VI—VI in FIG. 4.

In FIGS. 4, 5 and 6, components have been given the same reference numerals as much as possible as those of the corresponding components of the holder to be manufactured, but with an accent sign (') added to the reference numeral each time.

FIG. 4 diagrammatically shows a method of manufacturing the amalgam holder of the lamp according to the invention. A metal tape 33' is guided in its longitudinal direction 32' through a drawing die 40 (shown in broken lines). The tape 33' (shown in cross-section in FIG. 5) has a coating of an amalgam 31' or of a metal which will form an amalgam with mercury in the finished lamp, for example an alloy of lead and tin. According to the method shown, the tape 33' is cylindrically bent about an axis 32 parallel to the longitudinal direction 32', such that edge portions 34*a*', 34*b*' of the tape 33' will face towards one another. Then portions 30 of the tape 33' thus bent are sheared off with cutters 41*a*, 41*b*. Pinched ends 36*a*, 36*b* are formed thereby.

Figure 8:
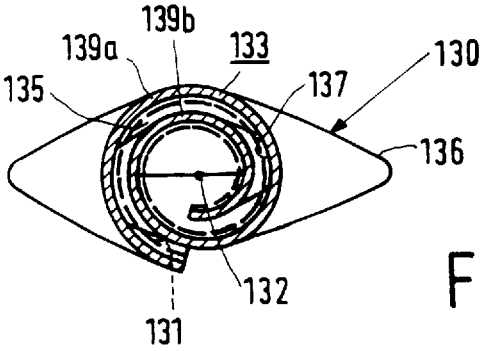
FIG. 8 shows the holder of the low-pressure mercury discharge lamp of FIG. 7.
Figure 7:
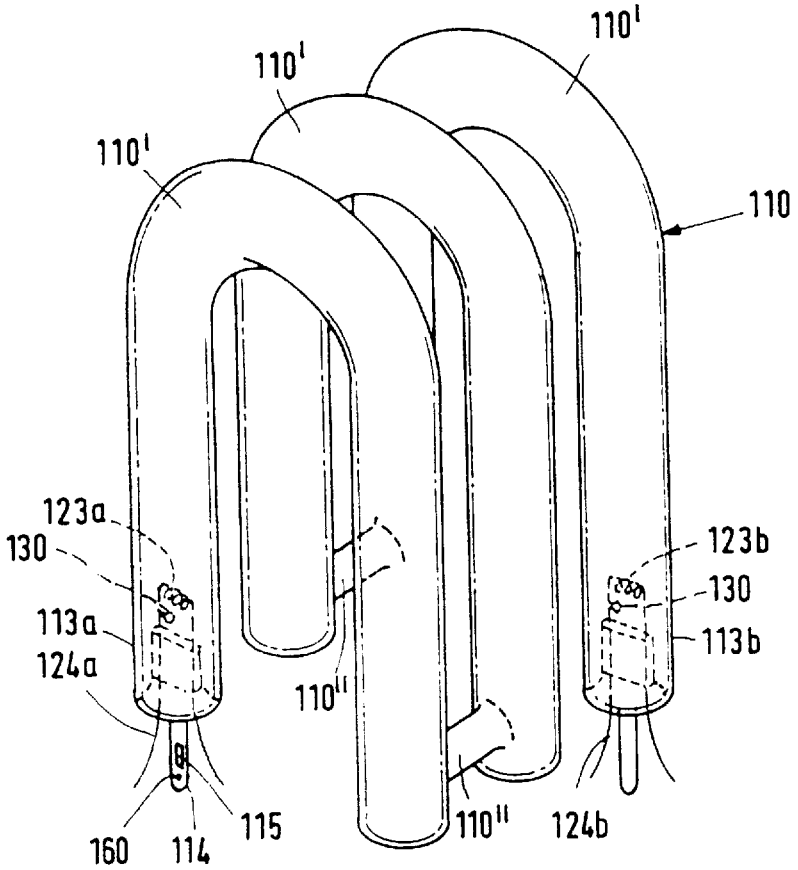
FIG. 7 shows a second embodiment of the low-pressure mercury discharge lamp according to the invention.

A second embodiment of the lamp according to the invention is shown in FIG. 7. Components therein corresponding to those of FIG. 1 have reference numerals which are 100 higher. The lamp shown in FIG. 7 is provided with a tubular discharge vessel 110. The discharge vessel 110 comprises three U-shaped bent tube portions 110' interconnected through channels 110". Electrodes 123*a*, 123*b* arranged in end portions 113*a*, 113*b* of the discharge vessel 110 form means for maintaining an electric discharge. A holder 130 is fastened to a current supply conductor 124*a*, 124*b* of each electrode 123*a*, 123*b*. FIG. 8 shows the holder 130 for the amalgam in cross-section. The metal plate 133 from which the holder 130 was formed was bent twice about the axis 132, so that the holder 130 has a spiralling cross-section. An outermost 139*a* and an innermost portion 139*b* of the plate 133 define a slot 135.

A further amalgam 160 is present in an extension 114 of the discharge vessel 110 and is kept spaced away from the electrode 123*a* by a glass rod 115.

I claim:

1. A low-pressure mercury discharge lamp provided with a light-transmitting discharge vessel (10, 110) which surrounds a discharge space containing mercury and a rare gas, and provided with means (20; 123*a*, 123*b*) for maintaining an electric discharge in said discharge space, a metal holder (30, 130) supporting an amalgam (31, 131) being arranged inside the discharge space, characterized in that the holder (30, 130) is a metal plate (33, 133) bent about an axis (32, 132), and in that portions (34*a*, 34*b*; 139*a*, 139*b*) of said plate bent towards one another define a slot (35, 135), the holder being pinched together at its ends (36*a*, 36*b*; 136), while the amalgam (31, 131) covers an internal surface (37, 137) of the holder.

2. A low-pressure mercury discharge lamp as claimed in claim 1, characterized in that the slot (35) extends between edge portions (34*a*, 34*b*) of the metal plate (33) which face towards one another.

3. A low-pressure mercury discharge lamp as claimed in claim 1, characterized in that the holder (130) has a spiralling cross-section.

* * * * *